US010532484B2

(12) United States Patent
Meier et al.

(10) Patent No.: US 10,532,484 B2
(45) Date of Patent: Jan. 14, 2020

(54) CHAIN SAW HAVING A MEASUREMENT SYSTEM AND METHOD FOR OPERATING A CHAIN SAW

(71) Applicant: Andreas Stihl AG & Co. KG, Waiblingen (DE)

(72) Inventors: Johannes Meier, Berngau (DE); Patrick Russ, Stuttgart (DE); Harald Mang, Winnenden (DE); Tommy Roitsch, Winnenden (DE); Simon Jug, Lorch (DE); Sven Mueller, Leutenbach (DE); Philipp Sandbuehler, Kraichtal (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 16/104,764

(22) Filed: Aug. 17, 2018

(65) Prior Publication Data

US 2018/0354153 A1 Dec. 13, 2018

Related U.S. Application Data

(63) Continuation of application No. PCT/EP2017/000231, filed on Feb. 17, 2017.

(30) Foreign Application Priority Data

Feb. 17, 2016 (DE) ..... 10 2016 001 952

(51) Int. Cl.
*B27B 17/00* (2006.01)
*B27B 17/02* (2006.01)

(52) U.S. Cl.
CPC ..... *B27B 17/0025* (2013.01); *B27B 17/02* (2013.01)

(58) Field of Classification Search
CPC ..... B27B 17/0025; B27B 17/02
See application file for complete search history.

(56) References Cited

U.S. PATENT DOCUMENTS 5,901,457 A * 5/1999 Harding ..... G01B 3/02 30/383
6,295,738 B1 * 10/2001 Risch ..... B23Q 17/24 33/263

(Continued)

FOREIGN PATENT DOCUMENTS

| | | |
|---|---|---|
| CA | 526083 A | 6/1956 |
| CA | 517069 A | 3/1961 |
| EP | 1946899 A1 | 7/2008 |

OTHER PUBLICATIONS

International search report dated Apr. 25, 2017 of international application PCT/EP2017/000231 on which this application is based.

(Continued)

*Primary Examiner* — Sean M Michalski
(74) *Attorney, Agent, or Firm* — Walter Ottesen, P.A.

(57) ABSTRACT

A motorized chain saw has a measuring system for measuring an object, in particular a trunk. The motorized chain saw has a saw chain, and the measuring system has an evaluation device. The measuring system includes a sensor system for capturing the movement of the saw chain as the saw chain rolls over an object to be measured. The evaluation device is configured to evaluate the movement of the saw chain captured by the sensor system. In a method for operating the motorized chain saw, the sensor system captures the movement of the saw chain as the saw chain rolls over an object to be measured, and the evaluation device evaluates the captured movement.

17 Claims, 2 Drawing Sheets

(56) References Cited

U.S. PATENT DOCUMENTS

| | | | | |
|---|---|---|---|---|
| 7,861,416 | B1 * | 1/2011 | Clark | B27B 17/0025 30/371 |
| 2003/0145477 | A1 * | 8/2003 | Fukuhara | G01C 7/04 33/521 |
| 2006/0277775 | A1 * | 12/2006 | Isele | B23D 59/002 33/286 |
| 2011/0197458 | A1 * | 8/2011 | Karrar | B23D 59/002 30/383 |
| 2014/0250707 | A1 * | 9/2014 | Erickson | B27B 17/0025 33/630 |
| 2015/0047491 | A1 * | 2/2015 | Schamberg | B27B 17/02 83/875 |

OTHER PUBLICATIONS

Written opinion of the international searching authority dated Apr. 25, 2017 of international application PCT/EP2017/000231 on which this application is based.

* cited by examiner

CHAIN SAW HAVING A MEASUREMENT SYSTEM AND METHOD FOR OPERATING A CHAIN SAW

CROSS REFERENCE TO RELATED APPLICATION

This application is a continuation application of international patent application PCT/EP2017/000231, filed Feb. 17, 2017, designating the United States and claiming priority from German application 10 2016 001 952.2, filed Feb. 17, 2016, and the entire content of both applications is incorporated herein by reference.

BACKGROUND OF THE INVENTION

After felling a tree, it is often necessary to divide the trunk into segments of a given size, in order to make the transport and further processing possible and easier. The further processing may be, for example, the preparation of firewood, boards, laths or beams. In order to cut the tree trunk to length, it is necessary to mark the trunk so that, when the trunk is divided up at the marking or markings, trunk segments with a desired dimension are produced.

In order to identify various distances on a trunk, it is known to fasten a metal rod having the desired length to the sprocket wheel cover of the chain saw. The metal rod is placed against the trunk and the trunk is provided with a marking of the desired length. It is also known to affix a laser to the handle of the chain saw, which identifies the required dimensions. For this purpose, the angle of the laser may be adjustable. Furthermore, it is known to employ scribes or simple yardsticks to measure off pieces of timber. However, these methods require a lot of time, are awkward and/or imprecise.

SUMMARY OF THE INVENTION

It is an object of the invention to provide a chain saw with a measurement system which simplifies the cutting of a trunk to length with a desired dimension.

This object can, for example, be achieved via a chain saw including: a saw chain; a measurement system including an evaluation device; the measurement system being configured to measure an object to be measured via the saw chain rolling over the object to be measured; the measurement system having sensors for capturing a movement of the saw chain as the saw chain rolls over the object to be measured; and, the evaluation device being designed to evaluate the movement of the saw chain captured by the sensors.

It is a further object of the invention to provide a method for operating a chain saw with a measurement system.

This object can, for example, be achieved via a method for operating a chain saw with a measurement system, wherein the chain saw includes a saw chain, the measurement system includes an evaluation device, the measurement system being configured to measure an object to be measured via the saw chain rolling over the object to be measured, the measurement system including sensors for capturing a movement of the saw chain as the saw chain rolls over the object to be measured, and the evaluation device being configured to evaluate the movement captured by the sensors. The method includes the steps of: capturing a movement of the saw chain as the saw chain rolls over an object to be measured via the sensors; and, evaluating the captured movement via the evaluation device.

For the chain saw with a measurement system it is provided that the measurement system has sensors for capturing the movement of the saw chain as the saw chain rolls over an object to be measured and in that an evaluation device is configured to evaluate the movement of the saw chain captured by the sensors. In order to measure off a segment of a trunk being cut to length or some other object being measured, one therefore need only roll the saw chain over the object being measured. This can be done, for example, by placing the chain saw on the object in the region of the tip of a guide bar of the saw chain and moving it along the object. In this process, the saw chain catches into the object and is placed in circulating movement around the guide bar as the chain saw moves. This movement of the saw chain is captured by the sensors. The movement captured by the sensors is evaluated at least in part by the evaluation device, especially by a microcontroller of the evaluation device. Advantageously, the movement captured by the sensors is converted by the evaluation device into a length dimension, corresponding to the path traveled by the saw chain on the object being measured, such as a tree trunk.

Because the saw chain itself is used as the measuring probe, additional devices such as yardsticks or the like may not be needed. The user need not carry along any extra measuring devices, and can conveniently move the chain saw by its handle along the object being measured. After the saw chain has been rolled over a segment of the desired length, the saw chain will already be at the location where the object needs to be marked, so that the marking can be done in simple fashion by inscribing the object with the saw chain. This provides for an easy handling.

Advantageously, the chain saw has a display element for indicating the captured dimension of the object. The captured dimension is advantageously displayed constantly on the display element during the measurement. Thus, the user need not set any desired dimension before performing the measurement, but instead he can roll the saw chain along the trunk until reaching a desired dimension. Since no user input capability is required, the measurement system may have a simple configuration. Alternatively, it may also be provided that a desired dimension can also be entered by the user on the measurement system. Preferably, the measurement system constantly subtracts the path traveled by the saw chain from the desired dimension entered, so that the display counts backward to zero and the desired dimension has been reached when the display shows zero. The display here may be optical or acoustical. An acoustical display is especially advantageous when the measurement system counts backward from a desired dimension, for example by putting out a sound signal upon reaching the desired dimension.

In one advantageous configuration, the chain saw has a drive sprocket for the saw chain and the sensors detect the movement of the saw chain adjacent to the drive sprocket. This produces an advantageous arrangement of the sensors. The chain saw in particular has a housing, and the sensors and the evaluation device, especially the microcontroller, are arranged in the housing. A simple retrofitting option is achieved for the measurement system when the housing includes a sprocket wheel cover and the sensors are arranged beneath the sprocket wheel cover. Preferably also the evaluation device, especially the microcontroller of the evaluation device, is arranged beneath the sprocket wheel cover. Advantageously, means of providing the energy needed by the measurement system, especially a battery or storage cell or the like, are also arranged in the housing, especially beneath the sprocket wheel cover. The display element may likewise be arranged on the sprocket wheel cover, but it may also be provided that the display element is arranged in another region of the chain saw, preferably one which is clearly visible to the user.

In order to accomplish a simple layout of the sensors with a sufficiently accurate measurement result, it is advantageously provided that the saw chain has chain links and that the chain links serve as pulse generators for the sensors. The detection of the individual chain links passing by the sensors may be done electrically, mechanically or optically, for example. The accuracy of the measurement system corresponds to the distance between consecutive chain links, which is usually sufficient for the marking of a tree trunk or the like.

The chain saw advantageously has a drive motor for driving the saw chain, which drives the saw chain via a clutch. The measurement system detects the movement of the saw chain advantageously at the power takeoff or output side of the clutch. In this way, the drive motor stands still during the measurement process and does not need to be moved along with the saw chain. In the case of chain saws with a combustion motor, such clutches are customary anyway. Even in chain saws with an electric motor a corresponding clutch may be advantageous in decoupling the saw chain and the measurement system from the electric motor.

Advantageously, a microcontroller of the evaluation device is configured to evaluate the movement of the saw chain captured by the sensors. The movement of the saw chain captured by the sensors may be partly or entirely evaluated by the evaluation device. The full evaluation advantageously involves the calculation of a length dimension corresponding to the path length rolled over by the saw chain.

For a method for operating a chain saw it is provided that the sensors capture the movement of the saw chain as the saw chain rolls over an object to be measured and that the evaluation device evaluates the captured movement. In this way, a desired length of an object being measured can be determined in an easy manner. Advantageously, the evaluation device, especially a microcontroller of the evaluation device, determines from the captured movement the dimension of the object over which the saw chain rolls. The determination of the dimension advantageously occurs during the movement of the saw chain. Advantageously, the dimension determined by the evaluation device is indicated on a display element of the chain saw. Advantageously, the display occurs already during the measurement process, so that a user can easily measure off a desired dimension and mark it after reaching the desired length, in order to cut the object to length at this site. Advantageously, the measurement system resets the captured dimension to zero upon exceeding a predetermined speed of the saw chain. A high speed of the saw chain results in particular when the user marks the object being measured, such as a tree trunk, with the tip of the saw chain by a rapid running over with the saw chain, such as crosswise to the trunk in the case of a tree trunk. This rapid rotary movement of the saw chain is advantageously utilized for the resetting of the measurement system.

In the operation of the chain saw, the measurement system is advantageously inactive. The measurement system advantageously has an active state and an inactive state, wherein the measurement system detects, evaluates, and/or indicates the dimension rolled over by the saw chain only in its active state. Advantageously, there is no display in the inactive state. Whether the measurement system in the inactive state of the measurement system continues to detect the movement of the saw chain is unimportant to the user. However, in order to save on energy, advantageously no detecting of the movement of the saw chain is provided during normal operation of the chain saw.

Advantageously, the sensors detect the movement direction of the saw chain. The evaluation device increases the measured value for a movement of the saw chain in a first movement direction, depending on the movement of the saw chain. The first movement direction advantageously corresponds to a movement of the chain saw forward and in the direction of the drive, in which the saw chain is driven in operation by the drive motor. Upon return movement of the chain saw, that is, when the saw chain is moving around the guide bar in a second opposite movement direction, the captured dimension is advantageously decreased according to the movement of the saw chain. In this way, the user can correct the measured value by moving the chain saw backward.

Advantageously, the chain links of the saw chain serve as pulse generators for the sensors. However, some other detection of the movement of the saw chain may be advantageous.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
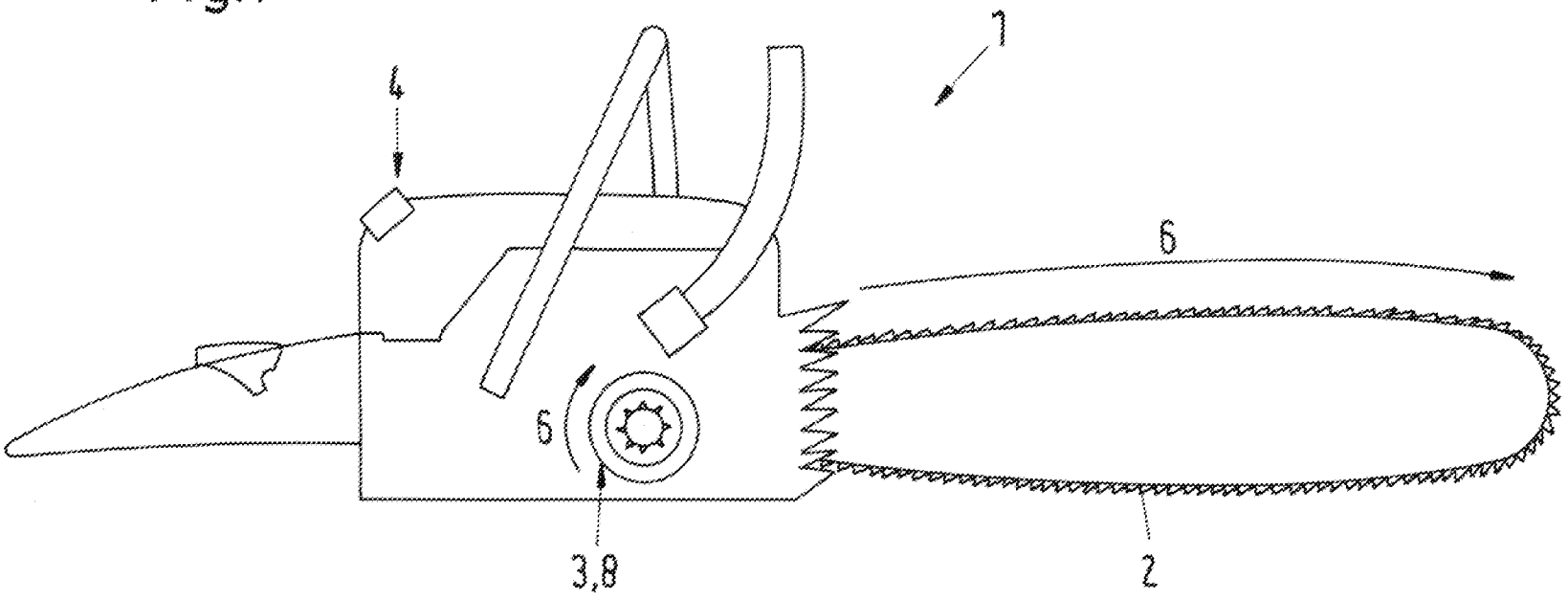
FIG. 1 is a schematic side view of a chain saw.

The chain saw 1 shown schematically in FIG. 1 has a saw chain 2 and a measurement system 3. The measurement system 3 includes an evaluation device, in the sample embodiment a microcontroller 8, which detects a movement 6 of the saw chain 2. The measurement system 3 furthermore includes a display element 4. The display element 4 is arranged in the upper region of the chain saw 1 on the side of the chain saw 1 facing away from the saw chain 2. In this way, the display element 4 can be well seen by the user standing behind the chain saw 1 or next to the chain saw 1.

The chain saw 1 is configured to measure the path traveled by the chain saw 1 with the saw chain 2 along an object being measured, such as a trunk, and to indicate this on the display element 4. For this, a user must roll the saw chain 2 over a trunk being measured or some other object being measured. The rotary movement 6 of the saw chain 2 is detected via sensors and evaluated at least partly by the microcontroller 8. The evaluated dimensions are indicated on the display element 4.

Figure 2:
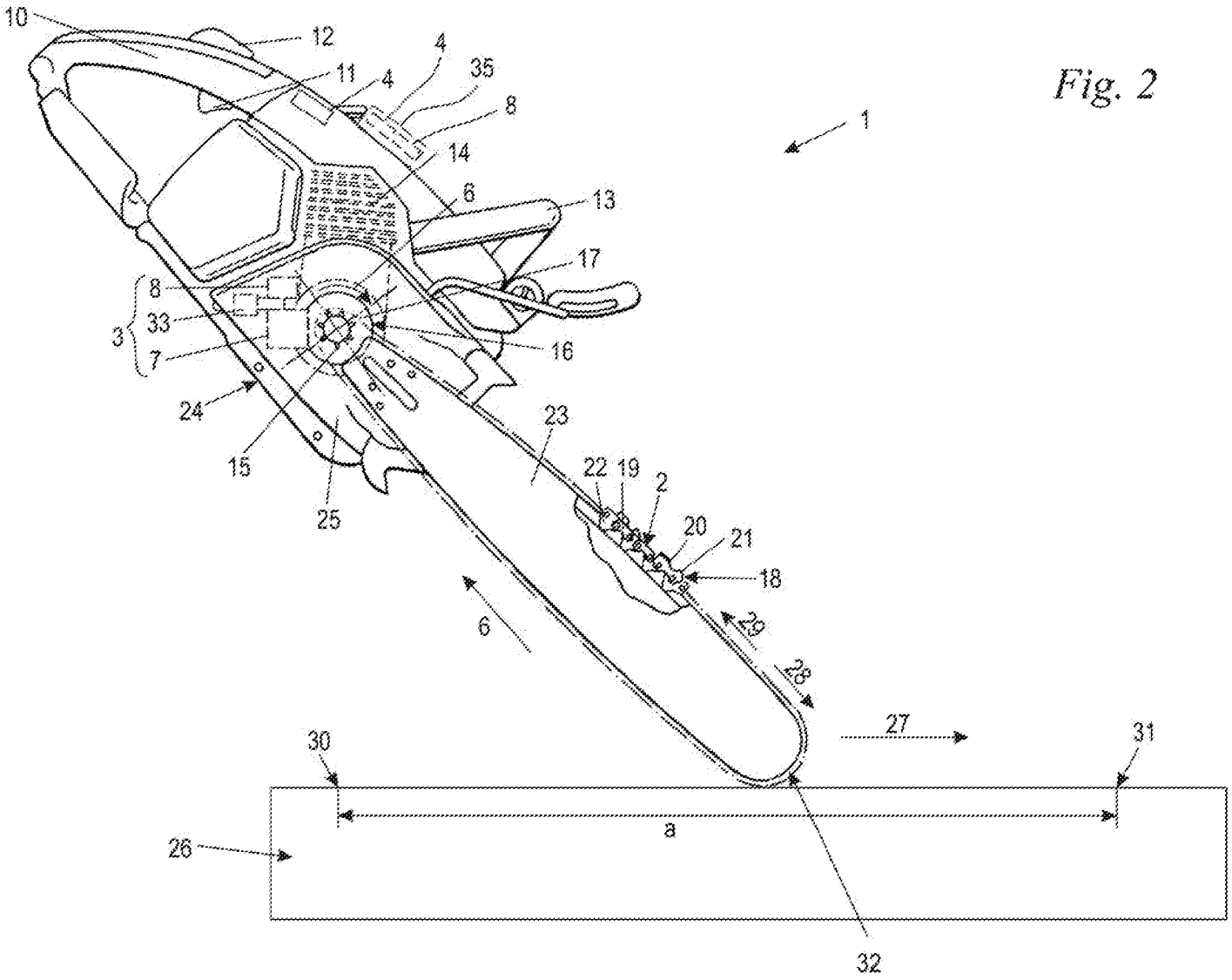
FIG. 2 is a schematic side view of a chain saw while measuring an object to be measured.

FIG. 2 shows the arrangement in detail. The chain saw 1 has a housing 24, on which are fastened a rear handle 10 and a bale handle 13 for guiding the chain saw 1 during its operation. On the rear handle 10 are pivotably mounted a throttle lever 11 and a throttle lever lock 12. The throttle lever 11 serves for actuating a drive motor 14 arranged in the housing 24. In the sample embodiment, the drive motor 14 is shown schematically as an internal combustion engine. However, the drive motor 14 may also be an electric motor. A guide bar 23 is secured to the housing 24 and the saw chain 2 is led along its outer circumference. The drive motor 14 drives a drive sprocket 15 across a centrifugal clutch 16, into which the saw chain 2 engages. The saw chain 2 is indicated schematically in FIG. 2. The centrifugal clutch 16 includes a clutch drum 17, on which the drive sprocket 15 is arranged. The clutch drum 17 and the drive sprocket 15 are situated at the power takeoff end of the clutch 16. As long as the speed of the drive motor stays below the clutch engaging speed of the centrifugal clutch 16, the drive sprocket 15 will not be turned by the drive motor 1.

The saw chain 2 includes connecting links 19 and drive links 22, which are articulated to each other. The connecting links 19 are partly fashioned as cutting links 18. The cutting links 18 each have a cutting tooth 20 and a depth limiter 21 situated in front of the cutting tooth 20. The depth limiter 21 is situated in front of the cutting tooth 20 in terms of the running direction of the saw chain 2, corresponding to the movement 6. The guide bar 23 has a tip 32, being the end of the guide bar 23 which is distant from the housing 24. The movement 6 of the saw chain 2 is a movement running around the guide bar 23, that is, a rotary movement, wherein the saw chain 2 moves in opposite directions along the opposite lengthwise sides of the guide bar 23.

For the measuring off of an object to be cut to length, such as a trunk 26 as shown schematically in FIG. 2, the chain saw 1 has the measurement system 3, including the sensors 7 and an evaluation device, namely, the microcontroller 8. Several evaluation devices, each one performing part of the evaluation, may also be advantageous. The display element 4 is also advantageously part of the measurement system 3. The measurement system 3 advantageously includes a power supply 33, especially a battery or a storage cell. Through the power supply 33, the measurement system 3 is supplied with energy when the drive motor 14 is not running. The chain saw 1 has a sprocket wheel cover 25, which is part of the housing 24. The guide bar 23 is held clamped by the sprocket wheel cover 25. The sensors 7 and the microcontroller 8 as well as the power supply 33 are arranged in the housing 24 beneath the sprocket wheel cover 25. The sensors 7 are preferably situated adjacent to the outer circumference of the drive sprocket 15. The sensors 7 are advantageously arranged such that the chain links of the saw chain 2 move past the sensors at slight distance during a rotary movement 6 of the saw chain 2. The microcontroller 8 may be situated adjacent to the sensors 7, be situated in a housing with the sensors 7, or be situated at a distance from the sensors 7. The microcontroller 8 may also be a microcontroller which is also provided for the control of the drive motor 14. The power supply 33 may likewise be arranged integrated in a housing with the sensors 7 and/or the microcontroller 8, or separate from them.

It may also be provided that the microcontroller 8 is arranged outside the chain saw 1. In particular, the microcontroller 8 is the microcontroller 8 of a computing unit 35, as shown schematically by broken line in FIG. 2. The sensors 7 preferably relay to the computing unit 35 signals corresponding to the pulses generated by the saw chain 2 at the sensors 7 and which are evaluated by the computing unit 35 and converted into a dimension over which the saw chain 2 has been rolled. In an embodiment, the computing unit 35 also includes the display element 4, as represented schematically by broken line in FIG. 2.

For the measuring off of an object being cut to length, such as the trunk 26, it is provided that the user places the chain saw 1 by the free end of the guide bar 23, preferably in the region of the tip 32 of the guide bar 23, against the trunk 26 and moves along the trunk 26. In the sample embodiment, a start point 30 and an end point 31 for the measurement are provided. The saw chain 2 is moved from the start point 30 to the end point 31 along the trunk 26 and in this process rolls over the trunk 26. The chain saw 1 is led in a movement direction 27 from the start point 30 to the end point 31 along the trunk 26. The sensors 7 detect the movement 6 of the saw chain 2 generated by the rolling along the trunk 26. During the movement of the chain saw 1 along the trunk 26, the chain links and especially the cutting teeth 20 of the cutting links 18 advantageously catch the trunk 26 and prevent the saw chain 2 from sliding along the trunk 26. The movement 6 is detected by the sensors 7. The microcontroller 8 evaluates the signal detected by the sensors 7 at least in part. In particular, the chain links serve as signal generators for the sensors 7, namely the connecting links 19, which also include the cutting links 18, and/or the drive links 22. The detection of the movement 6 may be done optically, electrically or mechanically, for example. It may also be provided that the sensors 7 detect the movement 6, namely, the rotary movement of the drive sprocket 15 or the clutch drum 17. The microcontroller advantageously determines from the movement 6 of the saw chain 2 the dimension a which corresponds to the distance between the start point 30 and the end point 31, that is, the length of the object being measured, namely, a segment of the trunk 26. The dimension a calculated by the microcontroller 8 is indicated on the display element 4. Advantageously, the detection, evaluation and indication occur in an ongoing manner during the entire measurement, so that the distance from the start point 30 is indicated to the user at every point traveled along the trunk 26. Alternatively, it may be provided that the user enters a desired dimension, for example on the computing unit 35, and the evaluation device subtracts the dimension already rolled over from the desired dimension and continuously displays the remaining residual length. The reaching of the desired dimension can be displayed to the user preferably optically and/or acoustically.

If the chain saw 1 is moved in the movement direction 27, the saw chain 2 will turn in a first movement direction 28. If the user moves the chain saw 1 too far and the indicated dimension a is greater than the desired dimension, for example, the user can advantageously move the chain saw 1 back in a direction opposite the movement direction 27. In this way, the saw chain 2 moves in a second movement direction 29, which is opposite the first movement direction 28. The sensors 7 advantageously detect not only the movement of the saw chain 2, that is, the length of the saw chain 2 having moved past the sensors 7, but also the movement direction 28 or 29 of the saw chain 2. If the saw chain 2 is moving in the first movement direction 28, corresponding to a movement of the chain saw 1 from the start point 30 toward the end point 31, the microcontroller 8 will increase the measured value a each time by the length of the saw chain 2 having moved past the sensors 7. If the chain saw 1 is moved in the opposite direction, so that the saw chain 2 is moving in the second movement direction 29, the microcontroller 8 will advantageously decrease the dimension a by the length of the saw chain 2 having moved past the sensors 7 in the second movement direction 29. In this way, a correction of the dimension a by the user is easily possible. Advantageously, the display element 4 continuously indicates during the measurement process the current dimension a, already traveled, or the current dimension yet to be traveled.

The measurement system 3 advantageously has an active state, in which the display element 4 indicates a dimension a and detects and evaluates the movement 6, and an inactive state in which no dimension a is indicated. In the inactive state, it may be provided that the measurement system 3 does not detect the movement 6 of the saw chain 2 or the microcontroller 7 does not evaluate a movement 6 detected.

It may be provided that the measurement system 3 is switched by the user between the active and the inactive state, for example, by activating an operator element. However, it is preferably provided that the measurement system 3 is switched from the active state to the inactive state depending on the speed of the saw chain 2. Advantageously, the measurement system 3 is then switched to the inactive state not later than when the speed of the drive sprocket 15 lies above the clutch engaging speed of the centrifugal clutch 16 and the drive sprocket 15 is driven by the drive motor 14.

In order to mark a dimension a of a trunk 26 that has been measured off, the user can move the chain saw 2 in a rapid movement along the trunk 26 and thereby inscribe and thus mark the trunk 26. During this movement, the speed of the saw chain 2 increases abruptly. Advantageously, the speed increase is utilized to reset the measurement system 3, that is, to set the dimension a to zero. Advantageously, a resetting of the dimension a occurs as soon as the speed of the saw chain 2 exceeds a given speed threshold, corresponding in particular to the speed when inscribing a trunk 26.

It is understood that the foregoing description is that of the preferred embodiments of the invention and that various changes and modifications may be made thereto without departing from the spirit and scope of the invention as defined in the appended claims.

What is claimed is:

1. A chain saw comprising:

a saw chain;

a measurement system including an evaluation device;

said measurement system being configured to measure an object to be measured via said saw chain rolling over the object to be measured;

said measurement system having sensors for capturing a movement of said saw chain as said saw chain rolls over the object to be measured; and, said evaluation device being designed to evaluate the movement of the saw chain captured by the sensors.

2. The chain saw of claim 1 further comprising a display element for indicating a captured dimension (a) of the object.

3. The chain saw of claim 1 further comprising:

a drive sprocket for said saw chain; and, said sensors being configured to detect the movement of said saw chain adjacent to said drive sprocket.

4. The chain saw of claim 1 further comprising:

a housing; and, said sensors and said evaluation device being arranged in said housing.

5. The chain saw of claim 4, wherein said housing includes a sprocket wheel cover; and, said sensors are arranged beneath the sprocket wheel cover.

6. The chain saw of claim 1, wherein said saw chain has chain links; and, said chain links serve as pulse generators for said sensors.

7. The chain saw of claim 1 further comprising:

a clutch having a power takeoff side;

a drive motor configured to drive said saw chain via said clutch; and, said measurement system being configured to detect the movement of said saw chain at said power takeoff side of said clutch.

8. The chain saw of claim 1, wherein:

said evaluation device includes a microcontroller;

the movement of said saw chain is a rotary movement; and, said microcontroller is configured to evaluate the rotary movement of said saw chain captured by said sensors.

9. A method for operating a chain saw with a measurement system, wherein the chain saw includes a saw chain, the measurement system includes an evaluation device, the measurement system being configured to measure an object to be measured via the saw chain rolling over the object to be measured, the measurement system including sensors for capturing a movement of the saw chain as the saw chain rolls over the object to be measured, and the evaluation device being configured to evaluate the movement captured by the sensors, the method comprising the steps of:

capturing a movement of the saw chain as the saw chain rolls over an object to be measured via the sensors; and, evaluating the captured movement via the evaluation device.

10. The method of claim 9, further comprising the step of determining via the evaluation device a dimension (a) of the object over which the saw chain rolls from the captured movement.

11. The method of claim 10 further comprising indicating the dimension (a) determined by the evaluation device on a display element.

12. The method of claim 11, wherein the chain saw includes the display element.

13. The method of claim 10, wherein the measurement system resets the captured dimension (a) to zero upon exceeding a predetermined speed of the saw chain.

14. The method of claim 10 further comprising the step of resetting the captured dimension (a) to zero upon exceeding a predetermined speed of the saw chain.

15. The method of claim 10, wherein:

the measurement system has an active state and an inactive state;

the measurement system is configured to detect, evaluate, and/or indicate the dimension (a) rolled over by the saw chain only in the active state; and, the measurement system is switched from the active state to the inactive state in dependence upon the speed of the saw chain.

16. The method of claim 9 further comprising:

detecting a movement direction of the saw chain via the sensors; and, wherein the evaluation device increases a measured value for a movement of the saw chain in a first movement direction and decreases it for a movement in a second, opposite movement direction.

17. The method of claim 9, wherein the saw chain includes a plurality of chain links and the chain links serve as pulse generators for the sensors.

* * * * *